United States Patent [19]

Robinson

[11] Patent Number: 4,922,963

[45] Date of Patent: May 8, 1990

[54] HYDRAULIC SERVOVALVE

[75] Inventor: William P. Robinson, Lockport, N.Y.

[73] Assignee: HSC Controls Inc., Buffalo, N.Y.

[21] Appl. No.: 316,181

[22] Filed: Feb. 27, 1989

[51] Int. Cl.[5] ..... F15B 13/043

[52] U.S. Cl. ..... 137/625.62; 137/625.38; 137/625.64; 137/625.68; 137/625.69

[58] Field of Search ..... 137/625.38, 625.62, 137/625.64, 625.68, 625.69

[56] References Cited

U.S. PATENT DOCUMENTS

| | | | |
|---|---|---|---|
| 2,853,976 | 9/1958 | Gerwig et al. | 137/625.64 |
| 2,875,782 | 3/1959 | Lee | 137/625.68 |
| 2,964,018 | 12/1960 | Farron | 137/625.64 X |
| 3,004,555 | 10/1961 | Haberland | 137/625.68 |
| 3,028,880 | 4/1962 | Reitman | 137/625.61 |
| 3,217,728 | 11/1965 | Pegram | 137/625.64 X |
| 3,437,101 | 4/1969 | Coakley et al. | 137/625.64 X |
| 3,857,541 | 12/1974 | Clark | 137/625.62 X |
| 3,990,477 | 11/1976 | Johnson | 137/625.69 |
| 4,201,114 | 5/1980 | Cobb et al. | 137/625.64 X |

*Primary Examiner*—Gerald A. Michalsky
*Attorney, Agent, or Firm*—Joseph P. Gastel

[57] ABSTRACT

A hydraulic servovalve including a valve body, a spool bore in the valve body, a spool in the spool bore, inlet and outlet conduits in the valve body, control conduits in the valve body, annular grooves on the spool for providing fluid flow paths between the inlet and outlet conduits and the control conduits, bores extending through the spool for providing additional fluid flow paths in addition to the fluid flow paths through the annular grooves, an inclined base on the valve body, a torque motor mounted on the inclined base, a flapper bore extending through the valve body transversely to the inclined base and lying in line with a diameter of the spool bore, a flapper in the flapper bore, and a filter bore in the valve body located laterally of the spool bore.

11 Claims, 5 Drawing Sheets

Fig. 10.
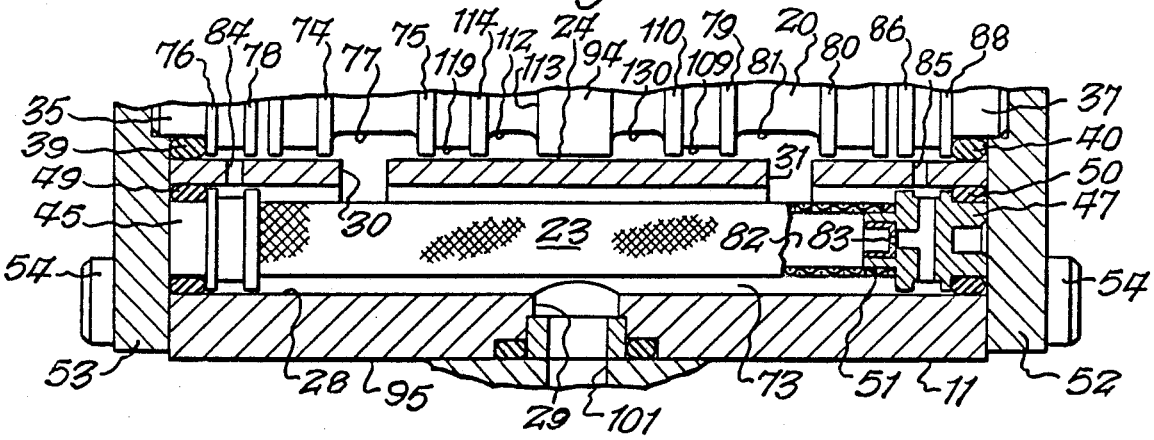
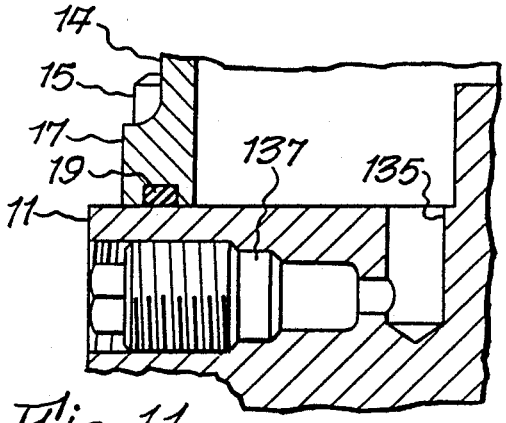
Fig. 11.
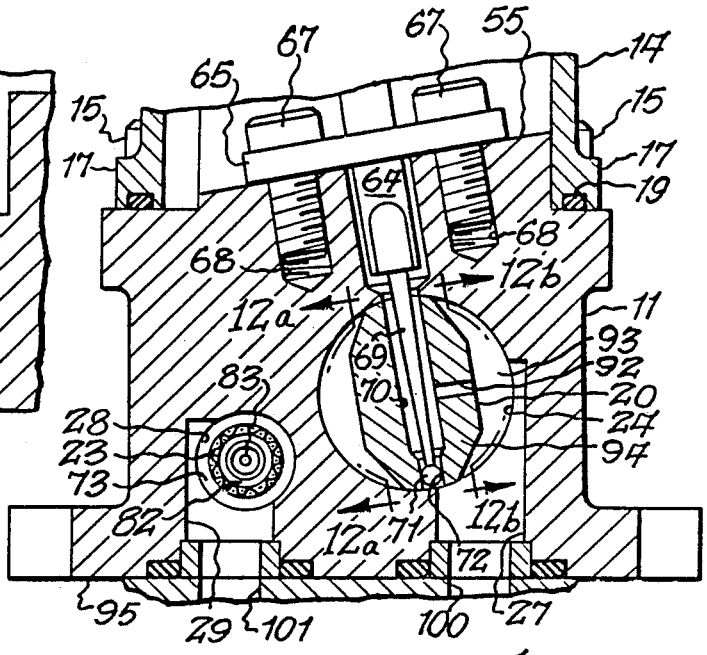
Fig. 12.
Fig. 13.
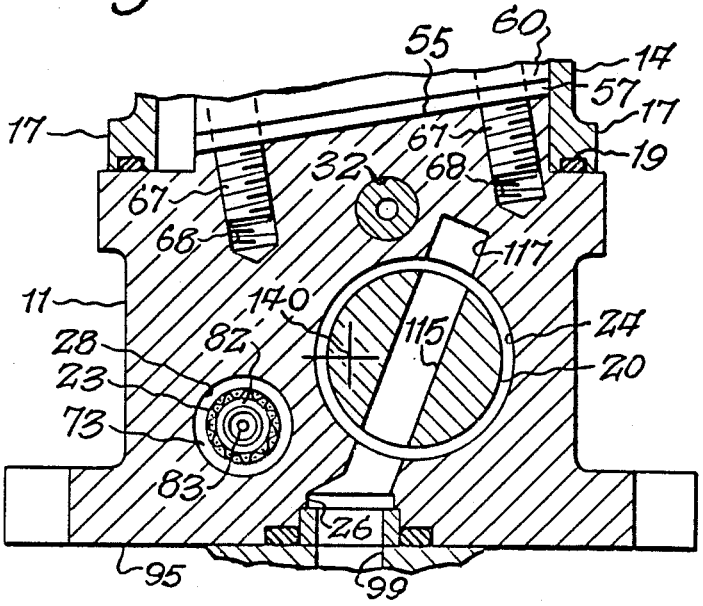
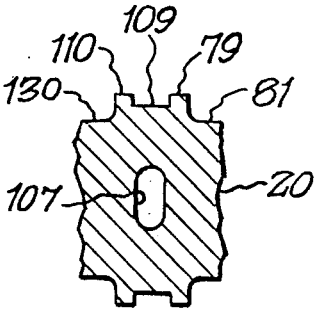
Fig. 8a.

Fig. 14.
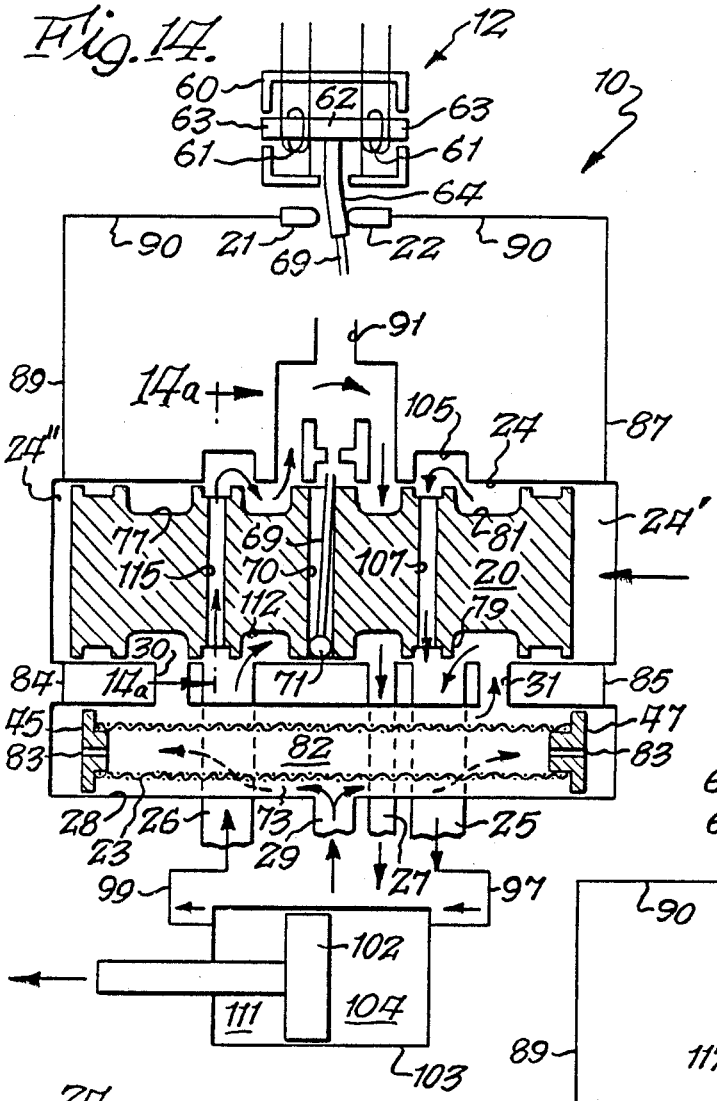
Fig. 14a.
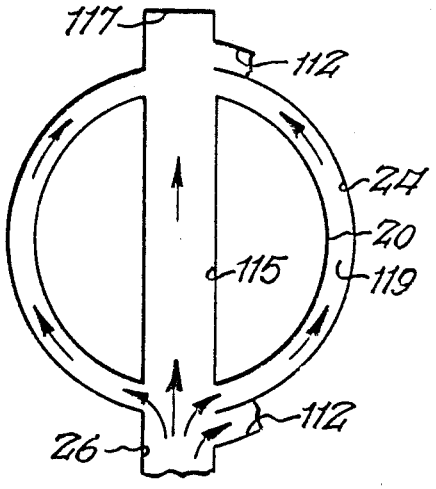
Fig. 15.
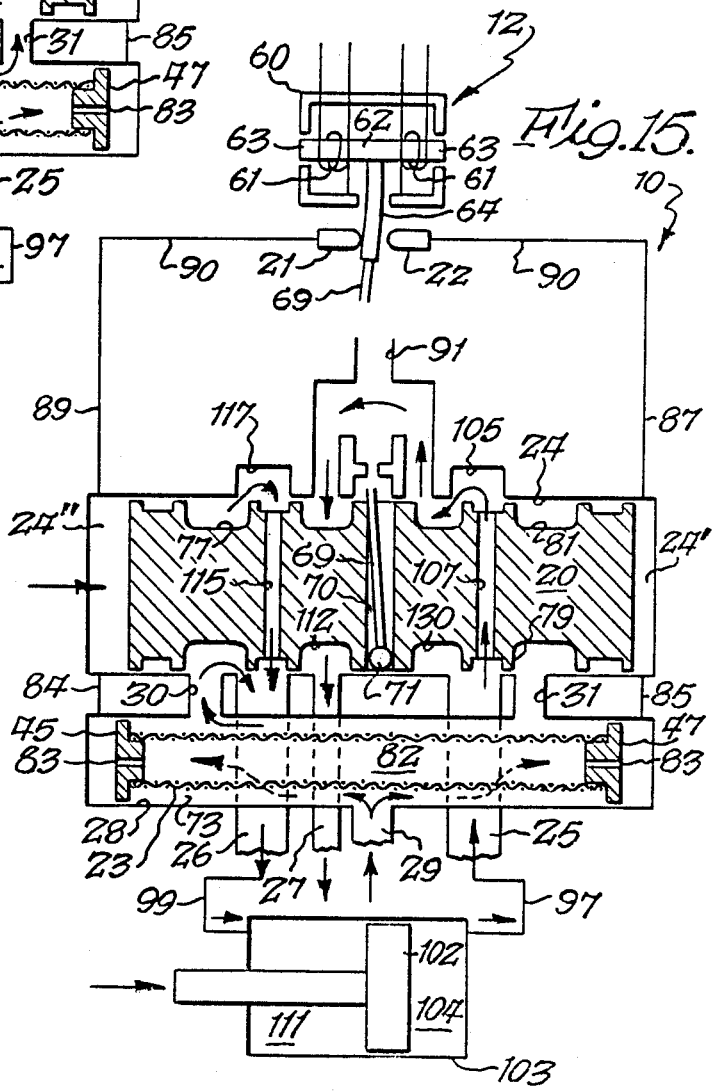
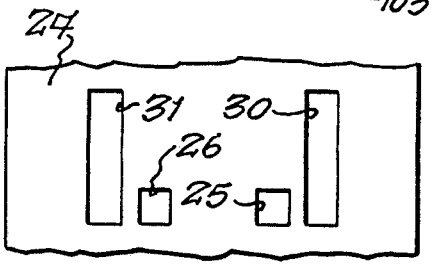
Fig. 12a.
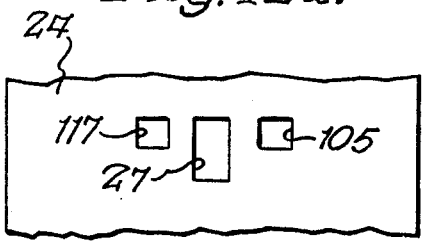
Fig. 12b.

HYDRAULIC SERVOVALVE

BACKGROUND OF THE INVENTION

The present invention relates to an improved hydraulic servovalve construction which will provide a relatively large capacity and yet have a relatively small size.

By way of background, in the past the size of a servovalve varied generally directly with its capacity, and various factors affected the size and capacity of a servovalve. A prior servovalve generally required a sleeve surrounding the spool for providing a proper fluid flow path through the valve body. Therefore, to obtain a desired spool driving force at a predetermined fluid pressure with a given size of spool, the size of the valve body of the spool had to be relatively large to accommodate the sleeve. In addition, the flow of fluid through a prior servovalve for operating a remote device was only through grooves around the spool of the servovalve. This limited the amount of fluid flowing through the valve body, and thus limited the capacity of the servovalve. Therefore, in order to obtain a greater fluid flow, the size of the spool had to be increased, which, in turn, increased the size of the valve body. In addition, the orientation of the various components of a prior servovalve including the spool bore and filter bore and the torque motor was such that the entire servovalve was relatively large.

SUMMARY OF THE INVENTION

It is accordingly one object of the present invention to provide an improved servovalve which does not utilize a sleeve surrounding the spool, thus permitting the valve body in which the spool is located to be made smaller for predetermined system pressures, and, conversely, if desired, the spool may be made larger for a given size of valve body to thereby obtain higher driving forces at predetermined system pressures.

It is another object of the present invention to provide an improved hydraulic servovalve in which the fluid flow into and out of the valve body is both through and around the spool thereby increasing the capacity of the valve over like valves in which the fluid flow into and out of the valve body is only around the spool. A related object is to provide an improved spool for a hydraulic servovalve in which the spool has bores extending therethrough in addition to the normal annular grooves on the outsides thereof to thereby increase the capacity of flow produced by a spool of a predetermined size.

Yet another object of the present invention is to provide an improved hydraulic servovalve in which the various parts are oriented in such a manner so as to produce a valve of a relatively large capacity within a relatively small valve body. Other objects and attendant advantages of the present invention will readily be perceived hereafter.

The present invention relates to a servovalve comprising a valve body, a spool bore in said valve body, a spool in said spool bore, inlet and outlet conduits in said valve body in communication with said spool bore, first and second control conduit means in said valve body for effecting communication between an external source and said spool bore, groove means in said spool for selectively effecting communication between said inlet conduit and one of said first and second control conduit means while causing the other of said control conduit means to be in communication with said outlet conduit to thereby effect first flow paths of fluid through said valve body, and bore means in said spool for providing second fluid flow paths for fluid which flows through said control conduit means.

The present invention also relates to a spool for a servovalve comprising an elongated substantially cylindrical body having a longitudinal axis and an outer periphery, annular groove means on said outer periphery spaced for conducting fluid flow about said periphery, and bore means extending through said body and transversely of said longitudinal axis for conducting additional fluid flow through said body.

The present invention also relates to a servovalve comprising a valve body, a spool bore in said valve body, an inclined base on said valve body for supporting a torque motor, and a bore in said valve body extending transversely between said inclined base and said spool bore for receiving a flapper.

The various aspects of the present invention will be more fully understood when the following portions of the present invention are read in conjunction with the accompanying drawings wherein:

Figure 6:
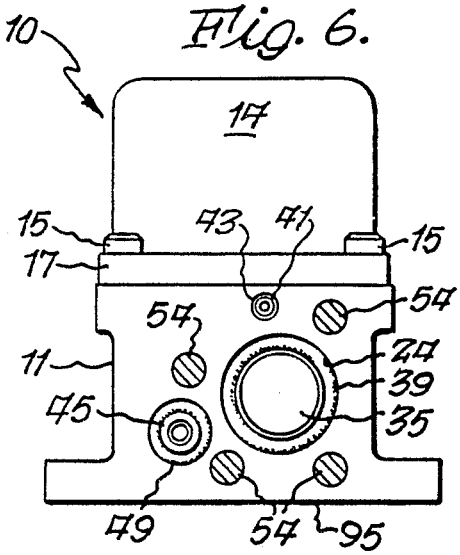
FIG. 6 is a view partially in cross section taken substantially along line 6—6 of FIG. 2.
Figure 1:
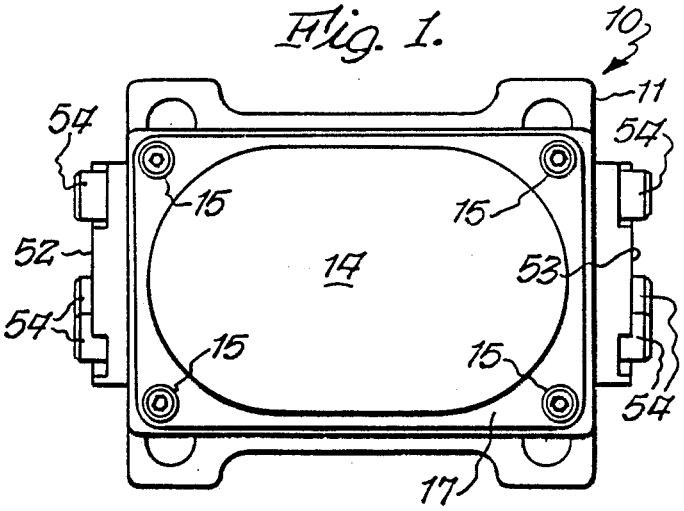
FIG. 1 is a top plan view of the improved servovalve of the present invention.
Figure 4:
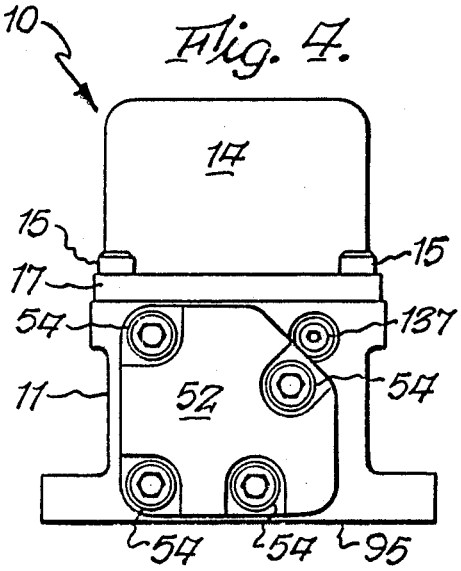
FIG. 4 is an end elevational view taken of the left side of FIG. 2.
Figure 2:
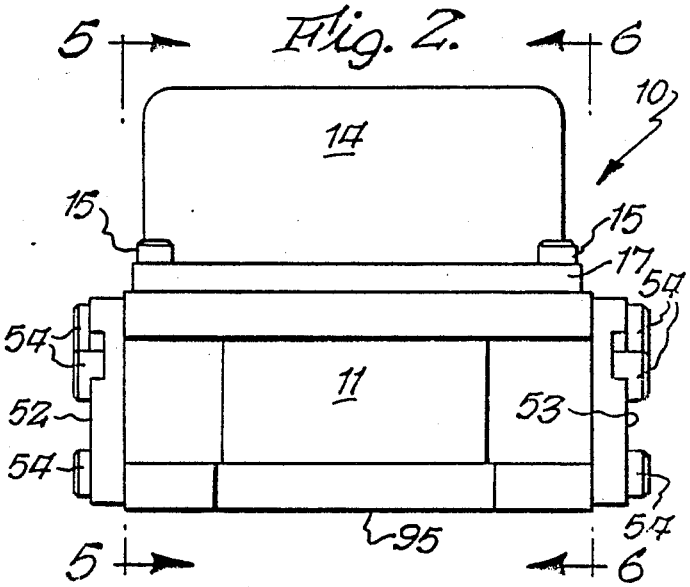
FIG. 2 is a side elevational view of the servovalve of FIG. 1.
Figure 5:
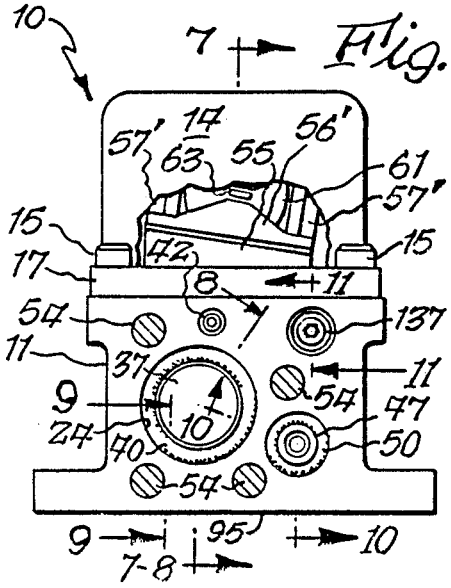
FIG. 5 is a view partially in cross section and partially broken away taken substantially in the direction of arrows 5—5 of FIG. 2.
Figure 3:
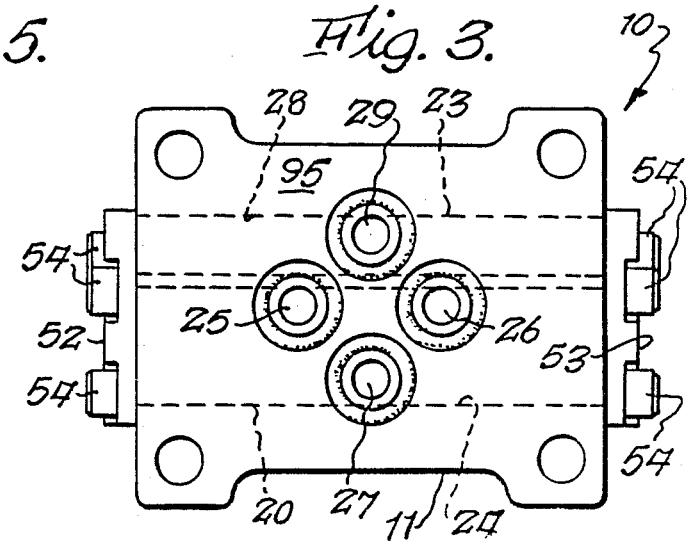
FIG. 3 is a bottom plan view of the servovalve of FIG. 1.
Figure 7:
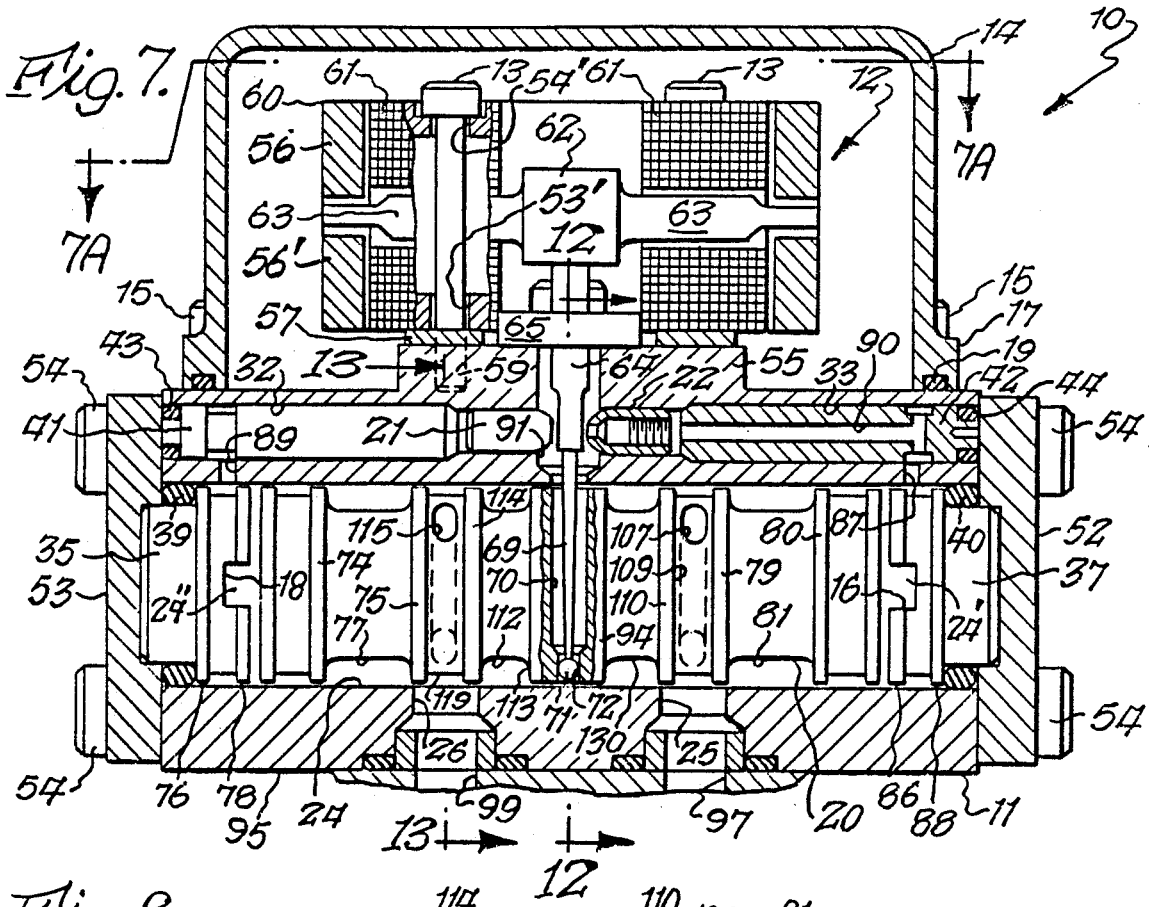
FIG. 7 is an enlarged fragmentary cross sectional view taken substantially along line 7—7 of FIG. 5 and showing the various components of the servovalve.
Figure 8:
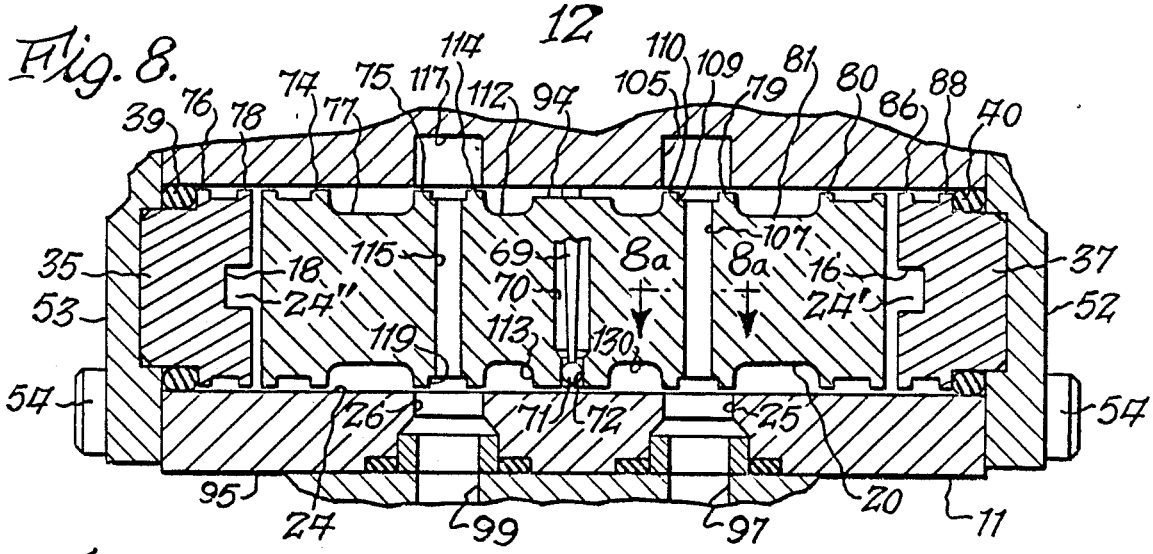
FIG. 8 is a fragmentary enlarged cross sectional view taken substantially along line 8—8 of FIG. 5 and showing the control conduits and the bores which extend through the spool and the blind bores in the valve housing in communication therewith.
Figure 9:
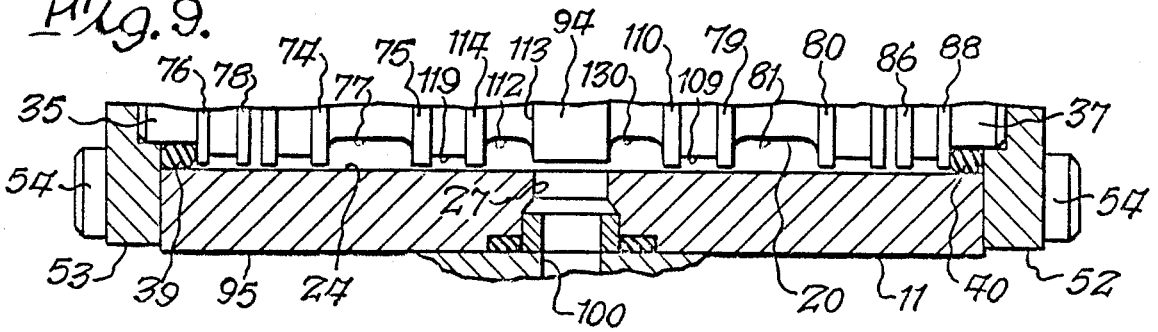
Figure 7A:
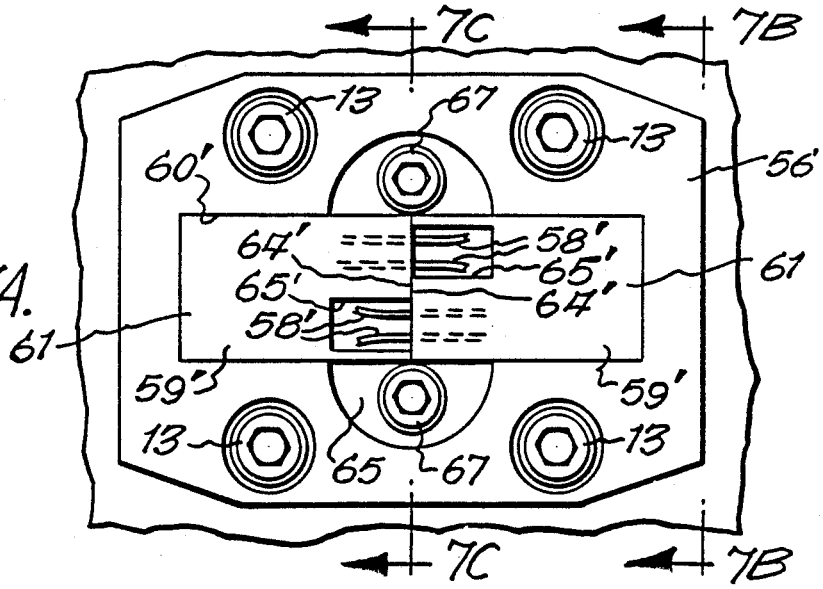
FIG. 7A is a fragmentary plan view of the top of the torque motor taken substantially in the direction of arrows 7A—7A of FIG. 7.
Figure 7B:
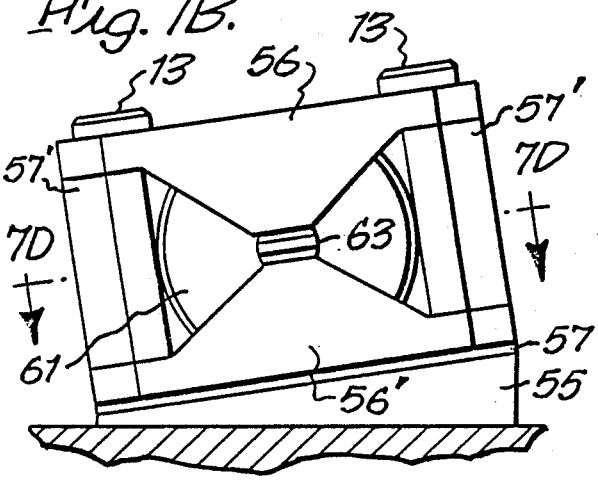
FIG. 7B is a fragmentary cross sectional view taken substantially along line 7B—7B of FIG. 7A.
Figure 7C:
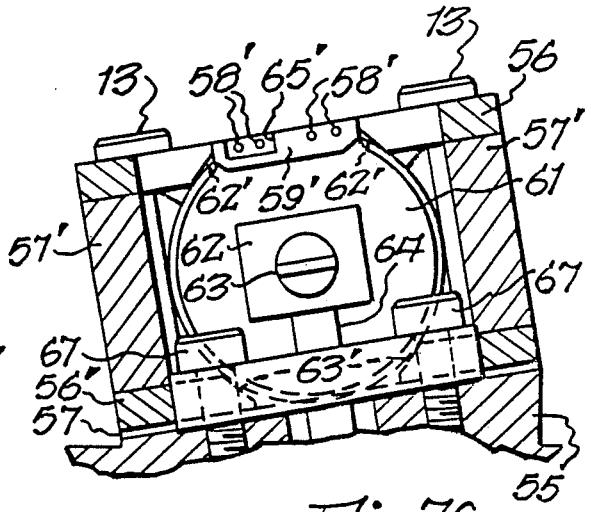
FIG. 7C is a fragmentary cross sectional view taken substantially along line 7C—7C of FIG. 7A.
Figure 7D:
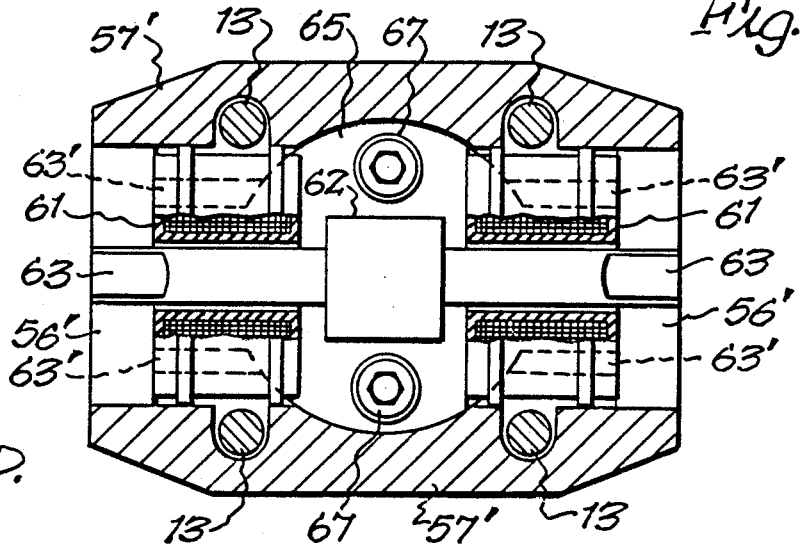
FIG. 7D is a cross sectional view taken substantially along line 7D—7D of FIG. 7B.

FIG. **8*a* is a fragmentary cross sectional view taken substantially along line 8*a*—8*a* of FIG. 8**;

FIG. 9 is an enlarged fragmentary cross sectional view taken substantially along line 9—9 of FIG. 5 and showing the fluid return conduit in the valve housing;

FIG. 10 is an enlarged fragmentary cross sectional view, partially broken away, taken substantially along line 10—10 of FIG. 5 and showing the fluid inlet conduit to the housing and the filter bore with the filter therein;

FIG. 11 is an enlarged fragmentary cross sectional view taken substantially along line 11—11 of FIG. 5 and showing a relief valve in the valve housing;

FIG. 12 is an enlarged fragmentary cross sectional view taken substantially along line 12—12 of FIG. 7 and showing the fluid inlet and outlet conduits and the inclined base for mounting the torque motor;

FIG. 12*a* is a fragmentary view taken substantially in the direction of arrows 12*a*—12*a* of FIG. 12;

FIG. 12*b* is a fragmentary view taken substantially in the direction of arrows 12*b*—12*b* of FIG. 12;

FIG. 13 is an enlarged fragmentary cross sectional view taken substantially along line 13—13 of FIG. 7 and showing the various relative positions of the filter bore, spool bore, control conduits, and the inclined base of the valve housing;

FIG. 14 is a schematic view of the fluid flow paths through the valve housing when the spool is displaced to the left of its neutral position;

FIG. 14*a* is a fragmentary schematic cross sectional view taken substantially along line 14*a*—14*a* of FIG. 14 and showing the flow paths of fluid through and around the spool; and FIG. 15 is a schematic view of the fluid flow paths when the spool is displaced to the right of its neutral position.

DESCRIPTION OF THE PREFERRED EMBODIMENTS

The improved servovalve 10 of the present invention includes a valve body 11 having a torque motor 12 (FIG. 7) attached thereto by screws 13 and located within cover 14 attached to the top of valve body 11 by a plurality of screws 15 which extend through flange 17 at the base of cover 14 and are received in suitably tapped bores (not shown) in the top of valve body 11. A gasket 19 provides a seal between valve body 11 and torque motor cover 14.

The valve body 11 houses a plurality of elements, namely, spool 20, nozzles 21 and 22 (FIG. 7) and first stage filter 23 (FIGS. 10 and 12). Spool 20 is located in spool bore 24 which is in communication with control conduits 25 and 26 (FIG. 8) and fluid outlet conduit 27 (FIG. 12). Filter 23 is located in filter bore 28 (FIGS. 10 and 12) which is in communication with fluid inlet conduit 29. Filter bore 28 is also in communication with spool bore 24 through conduits 30 and 31 (FIG. 10). Nozzles 21 and 22 are located in bores 32 and 33 (FIG. 7), respectively. Sealing plugs 35 and 37 and their associated O-rings 39 and 40, respectively, seal the ends of spool bore 24. Identical sealing plugs 41 and 42 and their associated O-rings 43 and 44, respectively, seal the ends of nozzle bores 32 and 33, respectively. Identical sealing plugs 45 and 47 (FIG. 10) and their associated O-rings 49 and 50, respectively, seal the ends of filter bore 28. Filter 23 is of hollow cylindrical structure, and one end is mounted on the end 51 of plug 47 (FIG. 10). The opposite end of filter 23 is mounted in the same manner on plug 45. End plates 52 and 53, which are substantially mirror-image counterparts, are attached to the ends of valve body 11 by screws 54 and retain the various plugs in position.

Torque motor 12 is mounted on inclined base 55 (FIGS. 7, 12 and 13) at the top of valve body 11. This mounting is effected by means of screws 13 which extend through holes 54' in and bear against top frame member 56 (FIG. 7) and extend through holes 53' in bottom frame member 56' and through holes (not numbered) in flat spacers 57 and are received in tapped bores 59 of inclined platform 55. Torque motor 12 includes a frame 60, consisting of frame members 56 and 56' which sandwich magnets 57', and coils 61 which have leads 58' which are suitably coupled to a suitable control for varying the direction and intensity of electrical current applied thereto, as is well known, and therefore not illustrated. Coils 61 are held in position within frame members 56 and 56' by beveled edges 62' and 63' thereon, respectively. Coils 61 are encapsulated in plastic which includes rectangular plastic top portions 59' which fit in slot 60' in to frame member 56 and which abut each other at edges 64'. Top portions 59' of each coil 61 are cut away at 65' to provide clearance for leads 58' of the other coil 61. An armature 62 has its outer portions 63 located within coils 61 suitably mounted on frame 60. A flapper 64 extends through a flexure or flapper spring 65 which is secured to inclined surface 55 by screws 67 which are received in tapped bores 68. The upper end of flapper 64 is suitably secured to the central portion of armature 62. A feedback spring 69 extends downwardly from flapper 64 and is received in bore 70 of spool 20. A ball 71 at the end of feedback spring 69 makes contact with the reduced end portion 72 of bore 70.

When torque motor 12 is not actuated, flapper 64 is centered between nozzles 21 and 22 and spool 20 occupies the centered neutral position shown in FIGS. 7–10. Thus, high pressure fluid which enters inlet or pressure conduit 29 (FIG. 10) will pass into filter chamber 28 and through the annular space 73 on the outside of filter 23 into valve conduits 30 and 31. However, at this time lands 74 and 75 on the opposite sides of spool groove 77 prevent further flow into spool bore 24. Likewise lands 79 and 80 on the opposite sides of spool groove 81 prevent flow of high pressure fluid from conduit 31 into spool chamber 24.

The flow from inlet conduit 29, however, will flow to nozzles 21 and 22 associated with flapper 64. This flow is from inlet conduit 29 (FIG. 10) through cylindrical filter 23 to chamber 82 within filter 23. Thereafter, flow will be through a conduit, such as 83, in each of end plugs 47 and 45, valve bores 84 and 85 (FIG. 10), spool bore 24, bores 87 and 89 (FIG. 7) which are in opposition to bores 85 and 84, respectively, and through bores such as 90 in nozzles 21 and 22 to chamber 91 in which flapper 64 is located. Lands 86 and 88 (FIGS. 10 and 7) of plug 37 conduct the fluid between bores 85 and 87 while permitting the fluid to enter spool chamber 24' to the right of spool 20 through slot 16 at the end of plug 37. Lands 76 and 78 of plug 35 conduct the fluid between bores 84 and 89 while permitting the fluid to enter spool chamber 24'' to the left of spool 20 through slot 18 at the end of plug 35. Thus bores 87 and 89 are in communication with spool chambers 24' and 24'', respectively. Since the flapper is in a centered neutral position, the force of fluid on opposite sides thereof will be equal. The fluid emanating from nozzles 21 and 22 will pass through flapper chamber 91 into spool conduit 70 and then into spool conduit 92 (FIG. 12) from which it passes into the space 93 on the outside of central spool portion 94 from which it passes into return conduit 27.

As is well understood, the surface 95 of valve body 11 is suitably mounted on a member 96 which has conduits 97, 99, 100 and 101 in communication with conduits 25, 26, 27 and 29, respectively, with suitable O-rings, not numbered, therebetween.

The servovalve 10, in this exemplary instance, is for controlling the movement of piston 102 of fluid motor 103. As will become apparent hereafter, the fluid flow through each of the inlet and outlet conduits of the valve is through a plurality of paths, which results in relatively large flows through a relatively small valve body. This flow is not only directly from the inlet and outlet conduits to the control conduits but also indirectly through and around the spool from the inlet and outlet conduits to the control conduits. The additional indirect flow paths are especially significant in providing increased fluid flows, considering that the depth of the grooves in the spool and the thickness of the spool lands are predetermined by well known design considerations. In the latter respect, the lands must be at least of a predetermined thickness and the grooves must be no greater than a predetermined depth for each spool size to avoid undesired flexing of the spool parts. Thus for each spool size the flow through the grooves is limited by their size, which, as noted above, is governed by design considerations.

To cause piston 102 to move to the left in FIG. 14, torque motor 12 is actuated to move spool 20 to the left to the position shown in FIG. 14. More specifically, flapper 64 is moved to the right to restrict flow of fluid from nozzle 22 while permitting increased flow from nozzle 21. This will cause an increase in pressure in conduit 87 and spool chamber 24' while causing a decrease in pressure in conduit 89 and spool chamber 24'', thereby causing spool 20 to move to the left. Thus, there can now be flow of high pressure fluid from annular portion 73 of filter bore 28 through valve conduit 31 and through spool groove 81 between lands 79 and 80 into control conduit 25, through conduit 97, and into motor chamber 104. In addition there will be flow of fluid around annular groove 81 into blind bore 105 and through spool bore 107 into control conduit 25. There will also be flow into control conduit 25 from blind bore 105 through annular groove 109 which is located between lands 79 and 110. Thus, the flow through spool bore 107 and annular groove 109 supplements the direct flow from annular groove 81 directly into control conduit 25.

Simultaneously with the flow of fluid into chamber 104 of motor 103 there will be a flow of fluid out of motor chamber 111 through conduit 99, control conduit 26, annular spool groove 112 between lands 113 and 114 directly to outlet conduit 27. In addition there will be a supplemental flow of fluid through spool bore 115 into blind bore 117 and into annular groove 112 directly to outlet conduit 27. Also, there will be flow from control conduit 26 into annular groove 119 of spool 20 and then into blind bore 117 from which it flows into valve groove 112 which leads directly to outlet conduit 27. Annular conduit 119 is located between lands 75 and 114. At this time inlet flow from conduit 30 will enter annular groove 77 but will be blocked from further flow because of the position of lands 74 and 75.

At this point it is to be noted that control conduits 25 and 26 (FIG. 12*a*) are quadrangular, and in this instance square. Inlet conduits 30 and 31 are also quadrangular, in this instance rectangular. Thus, when the spool 20 is in the position of FIG. 14, the edges of control conduit 25 coact with the edge of land 79 to produce a metering action. The edges of control conduit 26 and land 74 also produce a metering action. Thus, the amount of flow past spool 20 is determined by its position which in turn is determined by the amount of current which is supplied to the coils of the torque motor 12.

When it is desired to move piston 102 to the right in FIG. 15, torque motor 12 is actuated to move flapper 64 to the left closer to nozzle 21 to thereby increase the pressure in conduit 90 and chamber 24'' to the left of spool 20 while decreasing the pressure in conduit 87 and in spool chamber 24' to the right of spool 20. This will cause spool 20 to shift to the right to establish the fluid connections which will provide high pressure fluid to motor chamber 111 while permitting fluid to be exhausted from motor chamber 104. More specifically, after spool 20 has shifted to the right, there will be flow from inlet conduit 29 through the annular portion 73 of filter bore 28 and through valve conduit 30, spool groove 77, control conduit 26 and conduit 99 to chamber 111. There will also be a supplemental flow from spool groove 77 to blind bore 117, and spool bore 115 to control conduit 26. In addition there will be flow through spool groove 119 between lands 114 and 75 to control conduit 26. Thus the flow from valve conduit 30 to control conduit 26 is through the primary path directly through spool groove 77 and through the supplementary path consisting of spool bore 115 and spool groove 119. At this time there is a flow from chamber 104 of motor 103 through conduit 97, control conduit 25, and spool groove 130 directly to outlet conduit 27. In addition there is a supplemental exhaust flow through spool bore 107, blind bore 105 and spool groove 130 to outlet conduit 27. Additionally, there is a supplemental flow through annular groove 109 between lands 79 and 110 to blind bore 105 and thence to annular groove 130 leading to outlet conduit 27. The edges of control conduits 26 and 25 and lands 114 and 110 provide metering of fluid as determined by the position of spool 20. During the time that spool 20 is in the position of FIG. 15, the flow of inlet fluid from valve conduit 31 terminates at groove 81 between lands 79 and 80.

As is well understood, after the spool 20 has been moved by the actuation of torque motor 12, the feedback spring 69 will return the flapper to a neutral position which in turn will cause the pressure in spool chambers 24' and 24'' to become equalized which in turn will cause spool 20 to return to a neutral position.

In FIG. 11 a conduit 135 is shown as being in communication with spool chamber 24. A pressure relief valve 137 is in communication with conduit 135 so that if the pressure in the valve body should exceed a predetermined value, the pressure relief valve 137 will release it.

It can thus be seen that in both of the FIG. 14 and FIG. 15 positions of the spool 20 there are both direct and indirect flow paths for the fluid between the inlet and outlet conduits and the control conduits. This results in a relatively great capacity for a relatively small valve body.

To further reduce the size of the valve body 11, the various bores, especially spool bore 24 and filter bore 28 and the base 55 of torque motor 12 are oriented as shown in FIGS. 12 and 13. More specifically, by offsetting filter bore 28 relatively laterally of spool bore 24, rather than directly below it, the height of valve body 11 can be decreased. Furthermore, by mounting the torque motor 12 on inclined base 55, the width of valve body 12 can be decreased, as compared to a structure wherein the torque motor is mounted on a horizontal base. By using the inclined base the feedback spring 69 can be oriented on a diameter of the spool even though the torque motor and spool are offset from each other in a lateral direction. The foregoing can readily be visualized from FIG. 13. Assume that the center of the valve body is at 140. The control conduits 25 and 26 are on the centerline. The spool bore 24 and filter bore 28 are offset on opposite sides of the center 140. Furthermore, base 55 is inclined to lie perpendicularly to a plane passing through the axis of the spool bore. In addition, the control conduits are inclined so that their axes extend perpendicularly to the longitudinal axis of the spool. Furthermore, as can be seen from FIG. 12, the inlet and outlet conduits 29 and 27 extend in the attitudes shown, namely, offset from the centerlines of bores 28 and 24, so as to give a smaller valve body.

Furthermore, as can be seen from the above-described valve structure, there is no need for a ported sleeve surrounding the spool bore for providing fluid conduits, as is generally required in servovalves. This permits the spool itself to be of a relatively large diameter which in turn gives larger driving forces at lower system pressures.

While a preferred embodiment of the present invention has been described, it will be appreciated that it is not limited thereto, but may be otherwise embodied within the scope of the following claims.

What is claimed is:

1. A servovalve comprising a valve body, a spool bore in said valve body, a spool in said spool bore, a fluid inlet conduit in said valve body in communication with said spool bore, a fluid outlet conduit in said valve body in communication with said spool bore, first and second control conduits in said valve body in communication with said spool bore, first and second blind bores in said valve body in communication with said spool bore, first and second land means on said spool proximate said first and second control conduits, respectively, first groove means in said spool adjacent said first land means, second groove means in said spool adjacent said second land means, a first bore in said spool extending through said first land means for providing a fluid path between said first control conduit and said first blind bore, a second bore in said spool extending through said second land means for providing a fluid path between said second control conduit and said second blind bore, said first groove means effecting communication between said fluid inlet conduit and said first control conduit while said second groove means effect communication between said fluid outlet conduit and said second control conduit and while said first bore effects communication between said fluid inlet conduit and said first control conduit and while said second bore effects communication between said fluid outlet conduit and said second control conduit in response to a first position of said spool, said second groove means and said second bore effecting communication between said fluid inlet conduit and said second control conduit while said first groove means and said first bore effect communication between said fluid outlet conduit and said first control conduit in response to a second position of said spool, said first and second bores having first ends proximate the first and second control conduits, respectively, and having second end proximate said first and second blind bores, respectively, and third and fourth annular groove means in said first and second land means, respectively, for effecting communication between said first and second ends of each of said first and second bores, respectively.

2. A servovalve as set forth in claim 1 wherein said third and fourth groove means comprise annular grooves.

3. A servovalve as set forth in claim 1 wherein said inlet conduit terminates at first and second ports at said spool bore proximate said first and second land means, respectively, and first and second edges on said first and second land means, respectively, for coacting with said first and second ports, respectively, to meter fluid therefrom to said first and second control conduits, respectively.

4. A servovalve as set forth in claim 3 including third and fourth edges on said first and second blind bores, respectively, for coacting with said first and second edges, respectively, for metering flow from said first and second blind bores, respectively, into said first and second groove means, respectively.

5. A servovalve as set forth in claim 1 wherein said valve body has a base centerline, and wherein said first and second control conduits have first and second outer control ports on a first centerline on the outside of said valve body and first and second inner control ports on a second centerline at said spool bore, said first and second centerlines being laterally offset from each other and said second centerline being laterally offset from said base centerline, and wherein said spool bore is on a third centerline which is laterally offset from said base centerline and from said first and second centerlines.

6. A servovalve as set forth in claim 5 including an inclined base on said valve body, a torque motor mounted on said inclined base, and wherein a plane which contains said third centerline extends perpendicularly to said inclined base.

7. A spool for a servovalve comprising an elongated substantially cylindrical body having a longitudinal axis and an outer periphery, first and second adjacent annular groove means on said outer periphery for conducting fluid flow about said periphery, second and third adjacent annular groove means on said outer periphery axially spaced from said first and second adjacent annular groove means for conducting fluid flow about said periphery, first bore means extending through said body and transversely of said longitudinal axis at one of said first and second annular groove means for conducting additional fluid flow through said body, and second bore means extending through said body and transversely of said longitudinal axis for conducting additional fluid flow through said body, each of said bores terminating at each of its respective grooves.

8. A spool for a servovalve as set forth in claim 7 including additional grooves on said outer periphery spaced both axially inwardly and outwardly from all of said groove means.

9. A servovalve comprising a valve body, a spool bore in said valve body, a cylindrical spool in said spool bore, inlet and outlet conduits in said valve body in communication with said spool bore, first and second control conduit means in said valve body for effecting communication between an external source and said spool bore, first and second adjacent annular groove means in said spool for selectively effecting communication between said inlet conduit and said first control conduit means when said spool is in a first position, third and fourth adjacent annular groove means in said spool for effecting communication between said second control conduit means and said outlet conduit when said spool is in said first position, said first and second adjacent annular groove means being axially spaced on said spool from said third and fourth adjacent annular groove means, said first and second adjacent annular groove means in said spool effecting communication between said outlet conduit and said first control conduit means when said spool is in a second position, said third and fourth adjacent annular groove means in said spool effecting communication between said inlet conduit and said second control conduit means when said spool is in said second position, first bore means in said spool extending through said spool and between spaced portions of one of said first and second adjacent annular groove means, and second bore means extending through said spool and between spaced portions of one of said third and fourth adjacent annular groove means, said first and second bore means providing fluid flow paths for fluid which flows through said first and second control conduit means, respectively.

10. A servovalve as set forth in claim 9 wherein each of said first and second control conduit means comprise first and second conduits in said valve body in direct communication with said external source, and first and second blind bores in said valve body in communication with said first and second bore means, respectively.

11. A servovalve as set forth in claim 9 including first land means on said spool proximate said first and second groove means for selectively preventing flow between said inlet and one of said first and second control conduit means, second land means on said spool for proximate said third and fourth groove means for selectively preventing flow between said outlet conduit and the other of said first and second control conduit means, and first and second edges on said first and second land means, respectively, for metering flow of fluid through said inlet and outlet conduits, respectively.

* * * * *